US008551250B2

(12) United States Patent
Vente et al.

(10) Patent No.: US 8,551,250 B2
(45) Date of Patent: Oct. 8, 2013

(54) METHOD OF EXTRACTING SUGAR FROM SUGAR JUICE

(75) Inventors: Johan Alexander Vente, Heteren (NL); Paulus Josephus Theodorus Bussmann, Apeldoorn (NL); Moniek Afra Boon, Apeldoorn (NL); André Banier De Haan, Losser (NL)

(73) Assignee: Nederlandse Organisatie voor Toegepast-Natuurwetenschappelijk Onderzoek TNO, Delft (NL)

( * ) Notice: Subject to any disclaimer, the term of this patent is extended or adjusted under 35 U.S.C. 154(b) by 1065 days.

(21) Appl. No.: 11/884,399

(22) PCT Filed: Feb. 16, 2006

(86) PCT No.: PCT/NL2006/000081

§ 371 (c)(1),
(2), (4) Date: Mar. 27, 2008

(87) PCT Pub. No.: WO2006/088360

PCT Pub. Date: Aug. 24, 2006

(65) Prior Publication Data

US 2008/0168982 A1 Jul. 17, 2008

(30) Foreign Application Priority Data

Feb. 16, 2005 (EP) ..... 05075374

(51) Int. Cl.
*C13B 10/00* (2011.01)
*C13B 20/00* (2011.01)

(52) U.S. Cl.
USPC ..... 127/46.1; 127/9; 127/24; 127/30; 127/55

(58) Field of Classification Search
USPC ..... 127/9, 24, 30, 46.2, 46.3, 55, 46.1
See application file for complete search history.

(56) References Cited

U.S. PATENT DOCUMENTS 3,044,904 A 7/1962 Serbia
4,333,770 A 6/1982 Neuzil et al.

(Continued)

FOREIGN PATENT DOCUMENTS

FR 1191572 A 10/1959
GB 792284 3/1958
GB 1572607 A 7/1980

OTHER PUBLICATIONS

Nishio, M. et al.: "The CH/pi interaction: significance in molecular recognition" Tetrahedron, vol. 51, No. 32, Aug. 7, 1995, pp. 8665-8701, XP0002345783.

(Continued)

*Primary Examiner* — David A Reifsnyder
(74) *Attorney, Agent, or Firm* — Preti Flaherty Beliveau & Pachios LLP

(57) ABSTRACT

The present invention relates to a method of extracting a carbohydrate from a carbohydrate juice, said method comprising the steps of: a) providing an adsorbent having unsaturated hydrocarbon groups exposed on its surface wherein said groups are capable of adsorbing a carbohydrate to the (internal) surface of the adsorbent by CH/p interaction, and optionally in addition by hydrogen bonding; b) contacting said raw carbohydrate juice with said adsorbent under conditions by which said carbohydrate is adsorbed to said adsorbent by CH/p interaction, and c) desorbing said carbohydrate from said adsorbent by increasing the temperature of the carbohydrate-adsorbent complex.

44 Claims, 3 Drawing Sheets

(56) References Cited

U.S. PATENT DOCUMENTS

| | | | | |
|---|---|---|---|---|
| 4,533,398 | A | | 8/1985 | Neuzil et al. |
| 4,968,353 | A | | 11/1990 | Kawasaki et al. |
| 5,466,294 | A | | 11/1995 | Kearney et al. |
| 5,869,002 | A | * | 2/1999 | Limon et al. ..... 422/417 |

OTHER PUBLICATIONS

Kier, L. B.: "A Molecular Theory of Sweet Taste" Journal of Pharmaceutical Sciences, vol. 61, No. 9, 1972, pp. 1394-1397, XP009053994.

* cited by examiner

METHOD OF EXTRACTING SUGAR FROM SUGAR JUICE

This application is a §371 national phase filing of PCT/NL2006/000081 filed Feb. 16, 2006, and claims priority to European application No. 05 075 374.8 filed Feb. 16, 2007.

FIELD OF THE INVENTION

The invention relates to methods of extracting sugar from sugar liquors by continuous processes and to methods of purifying sugar juices using adsorption agents. More in particular, the present invention relates to methods for purification of sugars from raw sugar beet juice by chromatographic concentration and to devices for use in such methods.

BACKGROUND OF THE INVENTION

Sugar production from sugar beet is a continuous process which is very energy intensive and requires large amounts of water. Methods of extracting sugar from natural sugar sources such as sugar beet, sugar cane, generally involve the slicing of the plant material and "diffusing" the sliced material with hot water. The resulting sugar solution is combined with a juice resulting from pressing the exhausted plant material to form the raw juice or sugar liquor. This raw juice contains many organic and inorganic non-sugar impurities including plant derived substances, including both dissolved and undissolved solids, other than sucrose. Before it can be used for sugar production, these impurities must be removed at least partially, since proper crystallisation of the sugar is affected considerably by the degree of impurity of the raw juice. The conventional process for removal of non-sugar impurities is known as liming and carbonation and is based on calcium carbonate co-precipitation. The calcium carbonate is produced by adding lime and $CO_2$ to the raw juice. The precipitated chalk and non-sugar impurities are filtering out, the calcium concentration is further reduced by decalcification using ion exchange technology. The next stage of the process is concentration of the juice in a multi-stage evaporator in order to raise the sugar content from about 10-16% by weight to about 60-70% by weight. For crystallisation, the syrup is further concentrated into a thick juice by boiling under conditions that allow for crystallisation. The resulting crystals are separated from the mother liquor by centrifugation, upon which the crystals are dried with hot air before being stored and/or packed.

As it is not feasible to crystallize all of the sucrose in the thick juice as commercially acceptable sugar product. A large amount of the sugar is lost to a discard called "molasses". This inefficiency is largely due to the reality that the liming and carbonation "purification" procedures actually remove only a minor portion of the non-sucrose in the juice. The presence of residual non-sucrose in the thick juice significantly interferes with the efficient crystallization and recovery of the sucrose because of inherent crystallization and solubility effects.

Thus, the prior art methods for purifying sugar liquor and concentrating the sugar suffer from the fact that they are complex multi-step processes which consume large amounts of water and energy (approximately 15 cubic meters ($m^3$) of water and 28 kilowatt-hours (kWh) of energy per metric ton of beet), limestone (approximately 3% on beet basis) and cokes (0.2% on beet basis). The methods produce substantial amounts of waste products (e.g. calcium carbonate precipitate or "mud") and result in significant air emissions while resulting only in a limited purity of the thin juice and therefore require complex re-crystallization schemes. Altogether, the prior art methods are costly and inefficient.

U.S. Pat. No. 5,466,294 discloses an improvement of the process for purifying the raw juice obtained from sugar beets, outlined above. The process involves subjecting the raw juice to a chromatographic separation procedure utilizing an ion exchange resin. Although this process is based on ion exchange resins, the separation between sucrose and non-sucrose is based on ion exclusion rather than ion exchange. Ion exclusion is based on the fact that charged species (cations or anions) diffuse into the ion exchange matrix with more difficulty than small neutral molecules such as disaccharides or monosaccharides. The process disclosed in U.S. Pat. No. 5,466,294, however, has the disadvantage that the sugar juice is diluted and consequently large amounts of water have to be removed, which requires substantial amounts of energy, making it rather uneconomical. In addition it requires softening of the sugar juice.

U.S. Pat. No. 4,968,353 discloses another method for refining sugar liquor by the mineral cristobalite and an ion exchange resin. Cristobalite exhibits specific adsorbent properties for various colloidal or suspended substances, while the ion exchange resin exhibits decoloring and desalting properties with respect to colorants and salts. By combining refining by cristobalite and refining by the ion exchange resin, there is provided a sugar refining system. The process disclosed in U.S. Pat. No. 4,968,353 is based on ion exchange, which has a serious disadvantage that the process needs acids and bases to regenerate the ion exchange resins.

SUMMARY OF THE INVENTION

The present inventors have now found a method of purifying sugars from raw beet juice which does not suffer from the disadvantages of the prior art methods. The method presented herein is based on the principle of adsorption and desorption.

In a first aspect, the present invention provides a method of extracting a carbohydrate from a carbohydrate juice preferably a raw carbohydrate juice, said method comprising the steps of:

a) providing an adsorbent having unsaturated hydrocarbon groups exposed on its surface wherein said groups are capable of adsorbing a carbohydrate to the surface of the adsorbent by CH/π interaction, and optionally in addition by hydrogen bonding;

b) contacting said raw carbohydrate juice with said adsorbent under conditions by which said carbohydrate is adsorbed to said adsorbent by CH/π interaction, and optionally in addition by hydrogen bonding, and c) desorbing said carbohydrate from said adsorbent by increasing the temperature of the carbohydrate-adsorbent complex.

In a preferred embodiment of such a method, said carbohydrate is selected from the group consisting of a monosaccharide, a disaccharide, an oligosaccharide, a reduced monosaccharide, a reduced disaccharide, a reduced oligosaccharide, and mixtures thereof.

In another preferred embodiment of such a method, the adsorbent is a porous material, a gel type material or a monolithic (i.e. fabricated as a single structure) type material. More preferably the adsorbent is a porous material. Preferably, the pores in said material have a pore size of between 8 nm and 10 μm, preferably between 8 nm and 50 nm, and the porous adsorbent material preferably has a pore volume, $V_p$, in the range of between 0.1-5 $cm^3/g$, more preferably in the range of between 0.4 and 3 $cm^3/g$.

Preferably the material of the adsorbent is provided in the form of particles, preferably said particles having a mean diameter between 50 μm and 500 μm.

In another preferred embodiment of such a method, the adsorbent has a (internal) surface area in a range of between 100-1500 $m^2/g$, preferably of between 500-1500 $m^2/g$.

In yet another preferred embodiment of a method of the invention, the unsaturated hydrocarbon groups are olefins. Preferably the olefins are unsaturated straight-chain hydrocarbon groups selected from the group consisting of vinyl, allyl, butenyl, hexenyl, pentenyl, isoprene and combinations thereof. The straight-chain hydrocarbon groups are most preferably vinyl groups. A polyvinyl forms a very suitable adsorbent (surface) material.

In yet another preferred embodiment of such a method, the unsaturated hydrocarbon groups are cycloalkene groups.

In yet another preferred embodiment of a method of the invention, the unsaturated hydrocarbon groups comprise conjugated systems, preferably aromatic hydrocarbon groups, more preferably styrene or phenyl groups. A polystyrene forms a very suitable adsorbent (surface) material.

In a method of the invention step c) preferably comprises the use of hot water as a desorption liquid.

In another aspect, the present invention provides an apparatus for extracting a carbohydrate from a raw carbohydrate juice, said apparatus comprising:

a) an adsorbent having unsaturated hydrocarbon groups exposed on its surface wherein said groups are capable of adsorbing a carbohydrate to the surface of the adsorbent by CH/π interaction;

b) means for contacting said raw carbohydrate juice with said adsorbent under conditions by which said carbohydrate is adsorbed to said adsorbent by CH/π interaction, and c) means for desorbing said carbohydrate from said adsorbent by increasing the temperature of the carbohydrate-adsorbent complex.

The various embodiments foreseen in the aspect relating to the apparatus are the same as those for the method, i.e., the adsorbent characteristics of the apparatus are preferably those as described above in the method.

An apparatus according to the present invention comprises means for desorbing said carbohydrate from said adsorbent by increasing the temperature of the carbohydrate-adsorbent complex. In one embodiment said means may comprise heating means in the adsorbent and/or heating means in the wall of a column comprising the adsorbent. In an alternative embodiment, the means for desorbing said carbohydrate from said adsorbent comprises a source of desorption liquid, wherein said source of desorption liquid has means for heating the desorption liquid to the second temperature as described herein and wherein said apparatus further comprises means for contacting said desorption liquid with said adsorbent. For instance, said means for contacting said desorption liquid with said adsorbent may comprise a fluid flow system which system is on one end connected to said source of desorption liquid and in another end in contact with said adsorbent. The contact with said adsorbent may for instance be provided in the form of a fluid inlet passage connected to a column comprising the adsorbent. Said apparatus optionally further comprises fluid control means, such as pumps and valves.

An apparatus of the invention may be combined with other similar apparatuses to form a series of apparatuses. For instance, such a series of apparatuses may form part of a simulated moving bed (SMB) system.

DETAILED DESCRIPTION OF THE INVENTION

I. Definitions

Figure 1:
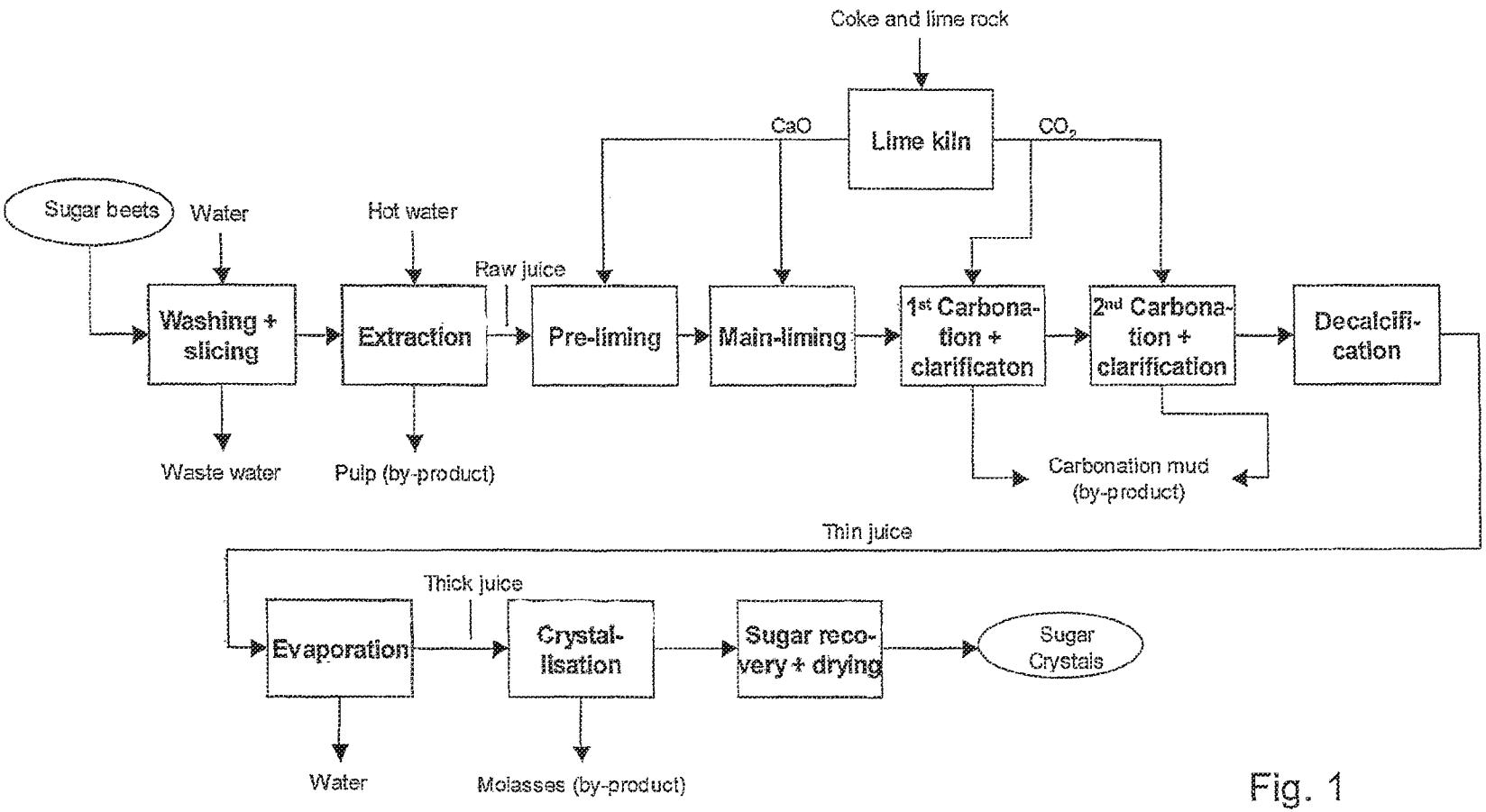
Fig. 1 PRIOR ART
FIG. 1 shows a schematic drawing of the general conventional (prior art) method for the production of sucrose (sugar) from sugar beets.

The term "interaction" as used herein refers in particular to the CH/π interaction (also commonly referred to as CH/pi interaction) between a carbon-hydrogen moiety (e.g. a C—H group of a carbohydrate) and a π (pi) electron system in a surface molecule of the adsorbent. The CH/pi interaction is a weak attractive molecular force occurring between CH groups and pi-systems and is described in more detail in Nihio et al., (1995) *Tetrahedron* 51:8665-701 and in *The CH/pi Interaction*, Nishio M, Hirota M, Umezawa Y (Eds.) John Wiley & Sons, New York, 1998. The term "interaction" also refers aromatic interaction (also known as charge-transfer interaction or π-π interaction), which is the noncovalent interaction between organic compounds containing aromatic moieties. π-π interactions are caused by intermolecular overlapping of p-orbitals in π-conjugated systems, so they become stronger as the number of π-electrons increases. The charge-transfer (CT) dative bond involves transfer of an electron from the highest occupied molecular orbital of the donor compound (π-electrons system group) to the lowest unoccupied molecular orbital of the acceptor (CH group of carbohydrate), and formation of a weak covalent bond by the unpaired electrons.

The term "pi-electron" or "π electron" is defined herein as one electron of a pi-bond. π bonds (or π bonds) are chemical bonds with a single nodal plane containing the line segment between two bonded atomic species. Atoms with double bonds or triple bonds have one sigma bond and the rest are usually π bonds. π bonds result from parallel orbital overlap: the two combined orbitals meet lengthwise and create more diffuse bonds than the sigma bonds. Electrons in π bonds are referred to as pi electrons. π bonds are named after the Greek letter "π", as in p orbitals, since the orbital symmetry of the pi bond is the same as that of the p orbital (when observed down the bond axis). P orbitals usually engage in this sort of bonding. However, d orbitals and even sigma bonds can engage in π bonding. π bonds are usually weaker than sigma bonds because their orbitals go further from the positive charge of the atomic nucleus, which requires more energy. From the perspective of quantum mechanics, this bond weakness is explained by significantly less overlap between the previously p-orbitals due to their parallel orientation. Although the π bond itself is weaker than a sigma bond, π bonds are only found in multiple bonds in conjunction with sigma bonds and collectively they are stronger than either single bond. π bonds do not necessarily have to connect atoms; π interactions between the metal atom and the σ bond of molecular hydrogen play critical roles in the reduction of some organometallic compounds. Alkyne and alkene π bonds often bond with metals in a bond that has significant π character.

As π-electron system in aspects of the present invention, compounds and molecules comprising at least one unsaturated hydrocarbon group may be used.

The term "unsaturated hydrocarbon" group as used herein refers to hydrocarbon groups in which one or more carbon-carbon single bonds have been converted to carbon-carbon double or triple bonds and includes in general such compounds as olefins and acetylenes. The term "unsaturated hydrocarbon" includes alkenyl and alkynyl groups and groups having more than one double or triple bond, or combinations of double and triple bonds. Unsaturated hydrocarbon groups include, without limitation, unsaturated straight-chain, unsaturated branched-chain or unsaturated cycloalkyl groups. Unsaturated hydrocarbon groups include without limitation: vinyl, allyl, propenyl, isopropanyl, butenyl, pentenyl, hexenyl, hexadienyl, heptenyl, cyclopropenyl, cyclobutenyl, cyclopentenyl, cyclopentadienyl, cyclohexenyl, cyclohexadienyl, 1-propenyl, 2-butenyl, 2-methyl-2-butenyl, ethynyl, propargyl, 3-methyl-1-pentynyl, and 2-heptynyl.

Unsaturated hydrocarbon groups may be optionally substituted. Suitable substitutions of unsaturated hydrocarbon groups include substitutions at one or more carbons in the group by moieties containing heteroatoms. Suitable substituents for these groups include but are not limited to OH, SH, $NH_2$, COH, $CO_2H$, $OR_c$, $SR_c$, P, PO, $NR_cR_d$, $CONR_cR_d$, and halogens, particularly chlorines and bromines where $R_c$ and $R_d$, independently, are alkyl, unsaturated alkyl or aryl groups. Preferred alkyl and unsaturated hydrocarbon groups are the lower alkyl, alkenyl or alkynyl groups having from 1 to about 3 carbon atoms. Substituted unsaturated hydrocarbon groups thus include aromatic groups in which one of the ring carbons is replaced by a heteroatom.

The term "heteroatom" includes in general trivalent or divalent atom including oxygen, nitrogen, sulphur, phosphorous and halogen.

The term "alkyl" takes its usual meaning in the art and as used herein, unless otherwise specified, refers to a saturated straight, branched, or cyclic, primary, secondary, or tertiary hydrocarbon of $C_1$ to $C_{20}$. The term includes, but is not limited to, methyl, ethyl, n-propyl, isopropyl, n-butyl, sec-butyl, isobutyl, tert-butyl, n-pentyl, isopentyl, cyclopentyl, sec-pentyl, neopentyl, 2-methylbutyl, 1-methylbutyl, 1-ethylpropyl, 1,1-dimethylpropyl, n-hexyl, isohexyl, cyclohexyl, cyclohexylmethyl, 1-methylpentyl, 2-methylpentyl, 3-methylpentyl, 4-methylpentyl, 2,3-dimethylbutyl, 3,3-dimethylbutyl, 2,2-dimethylbutyl, 1,1-dimethylbutyl, 2-ethylbutyl, 1-ethylbutyl, 1,3-dimethylbutyl, n-heptyl, 5-methylhexyl, 4-methylhexyl, 3-methylhexyl, 2-methylhexyl, 1-methylhexyl, 3-ethylpentyl, 2-ethylpentyl, 1-ethylpentyl, 4,4-dimethylpentyl, 3,3-dimethylpentyl, 2,2-dimethylpentyl, 1,1-dimethylpentyl, n-octyl, 6-methylheptyl, 5-methylheptyl, 4-methylheptyl, 3-methylheptyl, 2-methylheptyl, 1-methylheptyl, 1-ethylhexyl, 1-propylpentyl, 3-ethylhexyl, 5,5-dimethylhexyl, 4,4-dimethylhexyl, 2,2-diethylbutyl, 3,3-diethylbutyl, and 1-methyl-1-propylbutyl. Lower alkyl groups are $C_1$-$C_6$ alkyl and include among others methyl, ethyl, n-propyl, and isopropyl groups. The alkyl group can be optionally substituted with one or more moieties selected from the group consisting of hydroxyl, amino, alkylamino, arylamino, alkoxy, aryloxy, nitro, cyano, sulfonic acid, sulfate, phosphonic acid, phosphate, or phosphonate, either unprotected, or protected as necessary, as known to those skilled in the art, for example, as taught in Greene, et al. (1991) "*Protective Groups in Organic Synthesis*" John Wiley and Sons, Second Ed.

The term "olefin" as used herein refers generally to acyclic (branched or unbranched) and cyclic (with or without side chain) hydrocarbons having one or more carbon-carbon double bonds (short: double bonds). Olefins include the straight chain alkenes and the cycloolefins (or cycloalkenes) and their corresponding polyenes.

The term "alkene", as referred to herein, and unless otherwise specified, refers to a straight, branched, hydrocarbon of $C_2$ to $C_{20}$ with at least one double bond. The term includes reference to the acyclic branched or unbranched hydrocarbons having more than one double bond, generally referred to by their specific names such as alkadienes, alkatrienes, etc.

The term "cycloalkene", as used herein, refers to an unsaturated monocyclic hydrocarbon group having at least one endocyclic double bond. The terms "cycloalkadiene" and "cycloalkatriene" are included in the term cycloalkene and refer more specifically to unsaturated monocyclic hydrocarbon group having two and three double bonds respectively.

The term "acetylene" as used herein refers to an acyclic (branched or unbranched) or cyclic (with or without side chain) hydrocarbon group having at least one carbon-carbon triple bond, e.g. alkyne or cycloalkyne.

The term "alkyne" as used herein refers to an acyclic branched or unbranched hydrocarbon group having at least one carbon-carbon triple bond and the general formula $C_nH_{2n-2}$, RC═CR. Acyclic branched or unbranched hydrocarbons having more than one triple bond, generally referred to by the specific references alkadiynes, alkatriynes, etc., are included in the term "alkyne".

The term "cycloalkyne", as used herein, refers to an unsaturated monocyclic hydrocarbon group having at least one endocyclic triple bond.

The term "aromatic compound", as used herein, refers to compounds that, in accordance with the theory of Hückel, have a cyclic, delocalized (4n+2) π-electron system (where n is an integer). Such compounds include in particular arenes and heteroarenes and their substitution products.

The term "arene", as used herein, refers to a monocyclic or polycyclic aromatic hydrocarbon compound. Typical examples of arenes are benzene, naphthalene, toluene, xylene, styrene, ethylbenzene, cumene, and generally benzene rings with one or more aliphatic side chains or substituents.

The term "heteroarene", as used herein, refers to a heterocyclic compound formally derived from an arene by replacement of one or more methine (—C═) and/or vinylene (—CH═CH—) groups by trivalent or divalent heteroatoms, respectively, in such a way as to maintain the continuous π-electron system characteristic of aromatic systems and a number of out-of-plane π-electrons corresponding to the Hückel rule (4n+2) (where n is an integer). Typical examples of heteroarenes are thiophene, furan and pyridine.

The term "aryl" or its equivalent term "aromatic group" as used herein generally refers to a group derived from an arene by removal of a hydrogen atom from a ring carbon atom, and comprises at least one unsaturated cyclic hydrocarbon group or ring of about 3 to 14, preferably about 4 to 8, and more preferably about 5 to 7, carbon atoms, which ring has a conjugated pi electron system. The term "aryl" includes without limitation carbocyclic aryl, aralkyl, heterocyclic aryl, biaryl groups and heterocyclic biaryl, all of which can be optionally substituted, either unprotected, or protected as necessary, as known to those skilled in the art, for example, as taught in Greene, et al., "Protective Groups in Organic Synthesis," John Wiley and Sons, Second Edition, 1991. Preferred aryl groups have one or two aromatic rings.

"Aralkyl" refers to an aryl group bonded directly through an alkyl group, such as benzyl.

"Heteroaryl" or "heterocyclic aryl" groups are defined herein as groups derived from heteroarenes by removal of a hydrogen atom from a ring carbon atom, and having at least one heterocyclic aromatic ring with from 1 to 3 heteroatoms in the ring, the remainder being carbon atoms. Heterocyclic aryl groups include among others such heterocyclic aromatic groups as benzofuranyl, imidazolyl, indolyl, thienyl, furanyl, pyridyl, pyranyl, pyrrolyl, N-alkyl pyrrolo, pyrimidyl, pyrazinyl, oxazolyl, benzothienyl, benzofuranyl, quinolinyl, isoquinolinyl and acridintyl, all optionally substituted.

"Carbocyclic aryl" refers to aryl groups in which the aromatic ring atoms are all carbons and includes without limitation phenyl, biphenyl and napthalene groups.

"Aralkyl" refers to an alkyl group substituted with an aryl group. Suitable aralkyl groups include among others benzyl, phenethyl and picolyl, and may be optionally substituted. Aralkyl groups include those with heterocyclic and carbocyclic aromatic moieties.

"Heterocyclic biaryl" refers to heterocyclic aryls in which a phenyl group is substituted by a heterocyclic aryl group ortho, meta or para to the point of attachment of the phenyl ring to the decalin or cyclohexane. Heterocyclic biaryl includes among others groups which have a phenyl group substituted with a heterocyclic aromatic ring. The aromatic rings in the heterocyclic biaryl group can be optionally substituted.

"Biaryl" refers to carbocyclic aryl groups in which a phenyl group is substituted by a carbocyclic aryl group ortho, meta or para to the point of attachment of the phenyl ring to the decalin or cyclohexane. Biaryl groups include among others a first phenyl group substituted with a second phenyl ring ortho, meta or para to the point of attachment of the first phenyl ring to the decalin or cyclohexane structure. Para substitution is preferred. The aromatic rings in the biaryl group can be optionally substituted.

Arenes, heteroarenes, aryl groups and heteroarylgroups as defined above may be substituted with one or more moieties selected from the group consisting of hydroxyl; amino ($NH_2$); alkylamino; arylamino; alkoxy (O-alkyl), preferably lower-alkoxy, e.g., methoxy, ethoxy; aryloxy; carboxy; carbo-lower-alkoxy, e.g., carbomethoxy, carbethoxy; nitro; halo (chloro, bromo, iodo, or fluoro, preferably chloro or bromo); cyano; sulfonic acid; sulfato; sulfonyloxy; phosphonic acid; phosphate; phosphonate; saturated or unsaturated alkyl, preferably lower ($C_1$-$C_6$) alkyl, e.g., methyl, ethyl, butyl; mono- and di-lower-alkylamino, e.g., methylamino, ethylamino, dimethylamino, methylethylamino; amido; and lower-alkanoyloxy, e.g., acetoxy. Aryl group substitution includes substitutions by non-aryl groups (excluding H) at one or more carbons or where possible at one or more heteroatoms in aromatic rings in the aryl group. Substituents also include bridging groups between aromatic rings in the aryl group, such as —$CO_2$—, —CO—, —O—, —S—, —P—, —NH—, —CH═CH— and —$(CH_2)_i$— where i is an integer from 1 to about 5, and particularly —$CH_2$—. Examples of aryl groups having bridging substituents include phenylbenzoate. Substituents also include moieties, such as —$(CH_2)_i$—, —O—$(CH_2)_i$— or —OCO— $(CH_2)_i$—, where i is an integer from about 2 to 7, as appropriate for the moiety, which bridge two ring atoms in a single aromatic ring as, for example, in a 1, 2, 3, 4-tetrahydronaphthalene group. Alkyl and unsaturated alkyl substituents of aryl groups can in turn optionally be substituted as described supra for alkyl. Unsubstituted aryl, in contrast, refers to aryl groups in which the aromatic ring carbons are all substituted with H, e.g. unsubstituted phenyl (—$C_6H_5$), or naphthyl (—$C_{10}H_7$).

The term "carbohydrate" as used herein refers in general to sugars and sugar polymers. Carbohydrates are the members of a large class of chemical compounds, polyhydoxyaldehydes, and polyhydroxyketones, that includes sugars, starches, cellulose, and related compounds. There are three main classes of carbohydrates:

Monosaccharides are the simple carbohydrates, e.g., fructose, xylose, and glucose; they have the general formula $(CH_2O)_n$, in which n is an integer larger than 2. Monosaccharides may form glycosidic bonds with other monosaccharides, resulting in the formation of disaccharides, such as sucrose, maltose and trehalose, and polysaccharides such as starch.

Disaccharides include lactose, maltose, and sucrose. Upon hydrolysis, a disaccharide molecule yields two monosaccharide molecules. Most disaccharides have the general formula $C_n(H_2O)_{n-1}$, with n larger than 5.

Oligosaccharides are saccharide oligomers containing a small number (typically three to six) of component monosaccharides.

Polysaccharides include such substances as cellulose, dextrin, glycogen, and starch; they are polymeric compounds made up of the monosaccharides and can be hydrolyzed to yield individual monosaccharides.

The term "adsorption" as used herein refers to the physical process by which any compound, solid, liquid or gas, is loosely held by weak attractive forces to the surface of a solid. The process of adsorption as used herein involves separation of a carbohydrate (the adsorbate) from a liquid phase (the juice) accompanied by its accumulation or concentration at the surface of a solid phase (the adsorbent). Adsorption is different from absorption, which is a process in which material transferred from one phase to another (e.g. liquid) interpenetrates the second phase to form a "solution". In particular the term "adsorption" as used herein refers to adsorption by "CH/π interaction" as opposed to adsorptive processes due to such interactions as "hydrophobic interaction", wherein hydrophobicity is the basis for adsorption, "affinity interaction" wherein biological recognition is the basis for adsorption, or "ionic interaction" which forms the basis of ion exchange adsorption, wherein solutes carrying a net charge are retained by interaction with counter ions situated in the stationary phase and wherein the retentive mechanism involves simple electric forces between opposite charged ions. Also, the term "adsorption" as used herein is not intended to refer to activated carbon adsorption, which is caused mainly by Van der Waals forces. The term adsorption as used herein may in addition to CH/π interaction optionally involve hydrogen bonding between adsorbate molecules and adsorbent.

The term "desorption" as used herein refers to the process by which an adsorbed substance is released from the adsorbent due to loss of the attractive forces. The nature of the CH/π interaction means that desorption can be accomplished by raising the temperature of the CH/π bond. None of the prior art adsorption methods, for instance those based on ion exchange, will result in desorption or elution of accumulated carbohydrades by raising the temperature of the carbohydrate-adsorbent complex. For instance, the nature of the ion exchange interaction means that elution of bound substance may be achieved by altering the charge of the substance (e.g. change the pH in case of bound proteins), by increasing the salt concentration, or by providing a competing ion with a higher affinity for the exchanger. None of these measures will however affect desorption of carbohydrates adsorbed by CH/π interaction in a method of the present invention.

The terms "recovering", "refining", and "extracting", unless specifically mentioned otherwise, are used interchangeably herein and refer to the overall process of obtaining a relatively pure commercial carbohydrate product from a sugar juice. The terms "purifying" and "concentrating" are individual steps in the above process and are used in their art-recognized meaning.

II. The Adsorbent

The adsorbent used in aspects of the present invention includes an unsaturated hydrocarbon group. The unsaturated hydrocarbon group is exposed at the surface of the adsorbent such that the adsorbent can adsorb the carbohydrate by CH/π interaction. The adsorbent may consist entirely of one type of material having the unsaturated hydrocarbon group, or may comprise a support material coated with a material having the unsaturated hydrocarbon group exposed at the surface, for instance in the form of a surface functionalization.

Preferred unsaturated hydrocarbon groups in one embodiment are olefinic groups. Suitable examples of olefinic groups are the unsaturated straight-chain hydrocarbon group. Examples of unsaturated straight-chain hydrocarbon group include alkenes and alkynes. Particularly preferred examples of an unsaturated straight-chain hydrocarbon group are the vinyl group, the allyl group, the butenyl group, the hexenyl group, the pentenyl group, the isoprene group, etc. Most preferred unsaturated straight-chain hydrocarbon group is the vinyl group.

In another preferred embodiment of aspects of the present invention the unsaturated hydrocarbon group is a cycloalkene group, more preferably a cycloalkadiene or cycloalkatriene group.

In yet another preferred embodiment of aspects of the present invention the unsaturated hydrocarbon group is a cycloalkyne group.

Highly preferred unsaturated hydrocarbon groups used in aspects of the present invention are acyclic (branched or unbranched) or cyclic (with or without side chain) hydrocarbon having a chain or ring of carbon atoms which are individually bonded by alternating single and double bonds, i.e. wherein the double bonds are in an arrangement commonly referred to as a conjugated system. Highly preferred conjugated systems are aromatic groups or compounds. The most preferred unsaturated hydrocarbon group is the styrene group.

The skilled person is well aware how an adsorbent may be produced in which an unsaturated hydrocarbon group as referred to herein above is incorporated and exposed at the surface of the adsorbent such that the adsorbent can adsorb the carbohydrate by CH/π interaction.

The adsorbent may be produced by using chemical compounds readily available from commercial sources. Highly preferred compounds which may be incorporated into the adsorbent, and which comprise an unsaturated hydrocarbon group, are arenes and heteroarenes and their substitution products. Particularly preferred are styrenes. Most preferred are compounds having multiple π-electron systems. Compounds having multiple pi-electron systems include for instance polycyclic aromatic hydrocarbons, such as phenanthrene, anthracene, pyrene, benz[a]anthrecene, chrysene, naphthacene, naphthalene, benzo[c]phenanthrene benzo[ghi] fluoranthene, dibenzo[c,g]phenanthrene, benzo[ghi] perylene, triphenylene, o-tephenyl, benzo[a]pyrene, p-tephenyl, benzo[a]pyrene, tetrabenzonaphthalene, fluoranthene, fluorene and coronene. Other compounds having multiple π-electron systems include for instance polymers of aromatic monomers such as styrene (i.e. polystyrene) or polymers of vinyl aromatic monomers. Typical vinyl aromatic monomers which can be used include: styrene, alpha-methylstyrene chlorostyrene, all isomers of vinyl toluene, especially paravinyltoluene, all isomers of ethyl styrene, propyl styrene, tert-butylstyrene, divinylbenzene, diisopropenylbenzene, vinyl biphenyl, vinyl naphthalene, vinyl anthracene and the like, and mixtures thereof. The vinyl aromatic monomers may be copolymerized with other vinyl monomers such as acrylic monomers including acrylic acid, methacrylic acid, methylmethacrylate, ethylacrylate, isobutylacrylate, and acrylonitrile; vinyl esters such as vinyl acetate, vinyl propianate; vinyl halide monomers such as vinyl chloride, vinylidine chloride; olefinic monomers such as isobutylene, butadiene, neoprene; vinyl ethers such as methyl vinyl ether; or another unsaturated polymerizable monomer such as vinyl pyrrolidone.

As mentioned, the adsorbent may comprise essentially one type of material having the unsaturated hydrocarbon group, in which case the adsorbent essentially consists of an olefin or acetylene compound. Alternatively the adsorbent may comprise a support material, for instance an inorganic material, a ceramic-, polymer-, alumina or a silica-based material having a surface coating of an olefin or acetylene compound or having a surface which is functionalized with unsaturated hydrocarbon groups.

The adsorbent, as used in aspects of the present invention is capable of CH/π interaction and, optionally, hydrogen bonding. Preferably the adsorbent is an organic polymer of styrene, e.g. polystyrene, or a derivative of such polymer, constitutes another preferred adsorbent. Yet a polymer of vinyl, e.g. polyvinyl, or a derivative of such polymer constitutes another preferred adsorbent. Another preferred adsorbent is a organic polymer such as agrose or methacrylate functionalised with aromatic groups or derivatives of aromatic groups which are able to interact via CH/π interaction, and, optionally, hydrogen bonding. Yet another preferred adsorbent may be an inorganic porous material, such as alumina, silica, zeolite, or zirconiumoxide, which is functionalised with aromatic groups or derivatives of aromatic groups capable of CH/π interaction and, optionally, hydrogen bonding. Preferably the adsorbent has a high internal surface area: e.g. the adsorbent may be formed by a porous polymer (macroporous or macroreticular), or by a cross-linked polymer gel, or by a monolithic polymer structure.

As most carbohydrates are very hydrophilic the choice for the relatively hydrophobic adsorbent material (compared to ion exchangers) is rather surprising. This preferred choice is more or less based on an observation in a quite different area: it is known that proteins in taste buds or receptors in addition to hydrogen bonding groups contain aromatic groups that contain π-electrons for binding with carbohydrates like sugars (Kier L B (1972) *J. Pharm. Sci.* 61:1394-7). The involvement of aromatic groups suggests that CH/π interaction is important (Nihio et al., (1995) supra). The same interaction, optionally completed with formation of (a) hydrogen bridge(s), is used here to bind carbohydrates with the adsorbent. It is emphasized that according to the present invention the adsorbent is fit to accumulate the relevant carbohydrate, e.g. sugar on its internal surface by (physical-chemical) adsorption, while in the prior art methods and systems use is made of ion exclusion (U.S. Pat. No. 5,466,294) or ion exchange (U.S. Pat. No. 4,968,353).

The adsorbent used in aspects of the present invention is preferably porous in structure. An advantage of such porous structure is that a relatively low amount of adsorbent material already provides a relatively large capacity for carbohydrate adsorption.

Suitably, the pores have a pore size of between 8 nm and 10 μm, preferably between 8 nm and 50 nm.

The porous adsorbent material preferably has a pore volume, $V_p$, greater than 0.1 $cm^3/g$, preferably the material has a pore volume greater than 0.4 $cm^3/g$, the upper limit of the pore volume is suitably about 0.8, 1, 2 or about 5 $cm^3/g$.

The adsorbent may be provided in the form of a monolith, but is preferably provided in the form of particles, for instance in the form of beads. The particles are preferably porous, most preferably porous beads. Suitable particle sizes are between 10 μm and 1 cm, preferably the particles have mean diameters between 50 μm and 500 μm. Preferably all particles have about the same diameter (i.e. the particles preferably have a narrow size distribution).

The adsorbent material preferably has a large (internal) surface area, for instance larger than 100 $m^2/g$, preferably larger than 500 $m^2/g$. The upper limit of the surface area is suitably about 1500 $m^2/g$ As mentioned above, in one preferred embodiment, the compound for use in the adsorbent is polystyrene. Porous polystyrenes are highly preferred and are commercially available under such names as Amberchrom CG-161 (Rohm and Haas Company, Philadelphia, USA.

The adsorbent is preferably provided in the form of a column through which the raw juice and desorption liquid can flow. Preferably, the adsorbent is provided in a column suitable for use in a simulated moving bed chromatograohic process. The simulated moving bed chromatographic process is the technical realisation of a counter current adsorption process, approximating the countercurrent flow by a cyclic port switching and consists of a certain number of chromatographic columns in series while the counter current movement is achieved by sequentially switching the inlet and outlet ports one column downwards in the direction of the liquid flow.

The adsorbent used in aspects of the present invention preferably comprises a water-wettable surface, to allow interaction with the raw carbohydrate juice. The skilled person is well aware of methods to improve the wettability of hydrophobic materials, for instance by surface modification. One way of improving the wettability is by introducing groups capable of hydrogen bond formation. A hydrogen bond is formed between a hydrogen atom covalently bond to an electronegative element (proton donor) and a lonely electron pair of an (other) electronegative atom (proton acceptor). In principle, any molecule which has a hydrogen atom attached directly to a highly electronegative heteroatom such as a halogen, an oxygen, a sulphur, a nitrogen or a phosphorous atom is capable of hydrogen bonding. It is an advantage of such hydrogen bonding capacity of the adsorbent, and therefore a preferred characteristic of the adsorbent material, that as a result thereof hydrogen bonds may also be formed between the surface and the carbohydrate, thereby improving the adsorption.

III. The Carbohydrate Juice

The raw carbohydrate juice used in a method of the present invention may encompass any aqueous solution of dissolved carbohydrates, preferably an aqueous solution comprising a desired saccharide (i.e. a monosaccharide, disaccharide, oligosaccharide or an polysaccharide).

The liquor used in methods of the present invention is characterized in that it comprises a carbohydrate of interest which is to be recovered. Preferred liquors that are refined by the methods of the invention are raw sugar beet liquors.

The carbohydrate of said aqueous solutions may be a disaccharide. A commercially very important disaccharide is sucrose. Examples of aqueous sucrose solutions relevant to the invention are, "raw sugar juice" obtained from sugar beets, sugar cane or other plant material containing sugar, feeding a sugar refinery process. Another disaccharide may be found in the dairy industry. Lactose is the main carbohydrate in milk, skim milk, cheese whey, whey permeate, etc. In addition said disaccharide may be maltose, which is found in starch and malting industry. Furthermore, said carbohydrate may also be an oligosaccharide. Oligosaccharides are produced industrially, either by direct extraction from raw materials, or by conversion of purified carbohydrates with an acid or enzyme. Enzymatic production of oligosaccharides involves either the hydrolysis of polysaccharides or the transglycosylation of smaller sugars. Both methods produce mixtures of different types of oligosaccharides and monosaccharides. Examples of commercially produced oligosaccharides are trans-fructosyloligosaccharides (from sucrose), (trans-galactooligosaccharides (from lactose), lactosucrose (from sucrose and lactose), inulo-oligosaccharides, also called fructo-oligosaccharides (from inulin), glucosyl-sucrose (from sucrose and maltose), maltodextrins, also called malto-oligosaccharides (from starch), and iso-maltooligosacharides (from starch), palatinose-oligosaccharides (from sucrose), gentio-oligosaccharides (from glucose), soybean oligosaccharides (extraction from soybean whey), and xylo-oligosaccharides (from xylan). Furthermore, carbohydrate containing aqueous solutions may also be (waste)water streams e.g. resulting from washing used beverage bottles (containing e.g. sucrose, fructose and glucose), blanching water from vegetable or potato processing (containing e.g. sucrose, fructose, and glucose), or water from malt or beer brewing industry (containing e.g. maltose and glucose). Furthermore said carbohydrate may be a sweet tasting sugar derivative, e.g. sorbitol, xylitol or mannitol. In addition, said carbohydrate may be a mixture of (reduced) mono-, di-, and oligosaccharides.

Preferred carbohydrates include the commercially important reduced monosaccharides such as for instance sorbitol, xylitol and mannitol. More preferably, the dissolved carbohydrate to be extracted is a monosaccharide such as fructose or glucose, or a disaccharide such as lactose, maltose or sucrose. Most preferably the carbohydrate to be extracted from the raw carbohydrate juice is sucrose.

The raw juice may be pre-treated prior to being contacted with the adsorbent. Preferably, such pre-treatment comprises the removal of substances that can interfere with CH/π bond formation between carbohydrate and adsorbent. In particular such pre-treatment includes the removal of particulate, colloidal and/or precipitating material which may clog the adsorbent.

IV. The Extraction Method

A method of the present invention provides an improved method for refining a raw carbohydrate juice, i.e. a liquor comprising an aqueous solution of a carbohydrate. It is an advantage of the method of the present invention that simultaneous to the purification of the raw carbohydrate juice, concentration of the carbohydrate in the juice can be achieved.

The method involves the step of contacting the raw carbohydrate juice with an adsorbent, e.g. a porous solid, a gel type material or an adsorbent having a monolithic polymer structure, which adsorbent is fit or adapted to accumulate the desired carbohydrate on its (internal) surface or in the gel by CH/π interaction (viz. by CH/π adsorption), and in addition optionally by hydrogen bonding. This can be accomplished by providing an adsorbent having unsaturated hydrocarbon groups exposed on its surface and said groups being capable of adsorbing a carbohydrate to the surface of the adsorbent by CH/π interaction as described in great detail above.

The method of the present invention includes the step of imposing a temperature swing to the purification process. In essence this means that the method comprises the step of contacting the carbohydrate in the liquor with the adsorbent at a first, low, temperature, allowing the carbohydrate to bond to the adsorbent by CH/π interaction and upon accumulation of carbohydrate to the adsorbent surface, subsequently exposing the adsorbed carbohydrate to a second, higher temperature in order to break the CH/π interaction between the carbohydrate and the adsorbent and achieve desorption of the carbohydrate from the adsorbent. Essentially, the first, low, temperature is so low as to allow the bonding, and the bonded carbohydrate is desorbed by increasing the temperature of the adsorbent-carbohydrate complex, for instance by exposing the adsorbent to a warm desorption liquid to the level of the second temperature.

The temperature herein referred to as the first temperature is preferably between 0° C. and 40° C. The temperature herein referred to as the second temperature is preferably between 40° C. and 110° C.

The temperature difference between the first and second temperature is preferably between 10 and 100° C. More preferably the temperature difference between the first and second temperature is between 20 and 90° C., still more preferably between 40 and 80° C., most preferably between 60 and 70° C.

The step of desorbing the carbohydrate by raising the temperature of the carbohydrate-adsorbent complex may for instance be performed by using a desorption liquid (eluent) with a temperature higher than the feed temperature (i.e. the temperature at which the raw juice is loaded). Alternatively, heating of the carbohydrate adsorbent complex may also be performed by heating the adsorbent, more in particular the adsorbent's surface, e.g. by using a heated column wall, and contacting the adsorbent with a desorption liquid.

Preferably desorption is carried out using a hot desorption liquid, which may be a polar or an apolar liquid. Hot water (either in liquid of vapour phase) is the preferred desorption liquid, although another aqueous liquid such as for instance a heated liquor comprising an aqueous solution of said carbohydrate may also be used. The liquor may be the extract of a chromatographic separation. As the method as proposed above is based on adsorption (not based on ion exclusion or ion exchange), a temperature swing as proposed here can be used to collect the accumulated carbohydrate and to improve the efficiency. Contrary to that, in an ion exclusion based method a temperature swing does not improve the efficiency of carbohydrate collection. Due to using the temperature swing as proposed here, the resulting carbohydrate concentration is rather high, thus improving the process efficiency and effectiveness and lowering the process costs for "juice thickening".

The method of the invention preferably comprises a continuous process and is preferably encompassed in a SMB process as described above.

Figure 2:
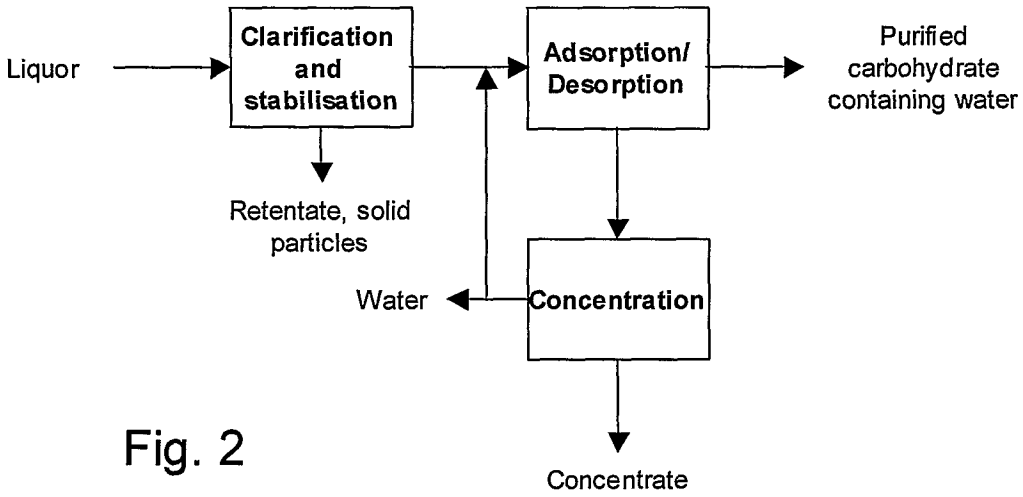
FIG. 2 shows a block diagram of a carbohydrate recovery process according to the present invention.

FIG. 2 shows a block diagram of a carbohydrate recovery process according to the present invention. Prior to the adsorptive separation step, the process stream may be freed from solid particles, which may otherwise result in clogging of the adsorbent column. Furthermore a process step may be included for the clarification of the carbohydrate containing process stream and in which colloidal and/or precipitating materials are removed, which would otherwise lead to clogging of the adsorption column or fouling of the adsorbent material in the adsorptive separation unit. The next step is the adsorptive separation step in which the carbohydrate is adsorbed by the adsorbent and desorbed by eluting the adsorbent with water. This process unit-operation may be either a(n) (cyclic) adsorptive separation process or a chromatographic separation process. Several technical embodiments of such processes are described in literature, see e.g. *Principles of adsorption and adsorption processes* D. M. Ruthven (1984), New York: John Wiley & Sons., and *Large-scale Adsorption and Chromatography* (2 vols.) P. C. Wankat, CRC Press, Boca Raton, (1986). A preferred embodiment is an SMB chromatographic process. SMB chromatography has been widely commercialised amongst others for the separation of glucose and fructose, and the desugarisation of molasses.

Figure 3:
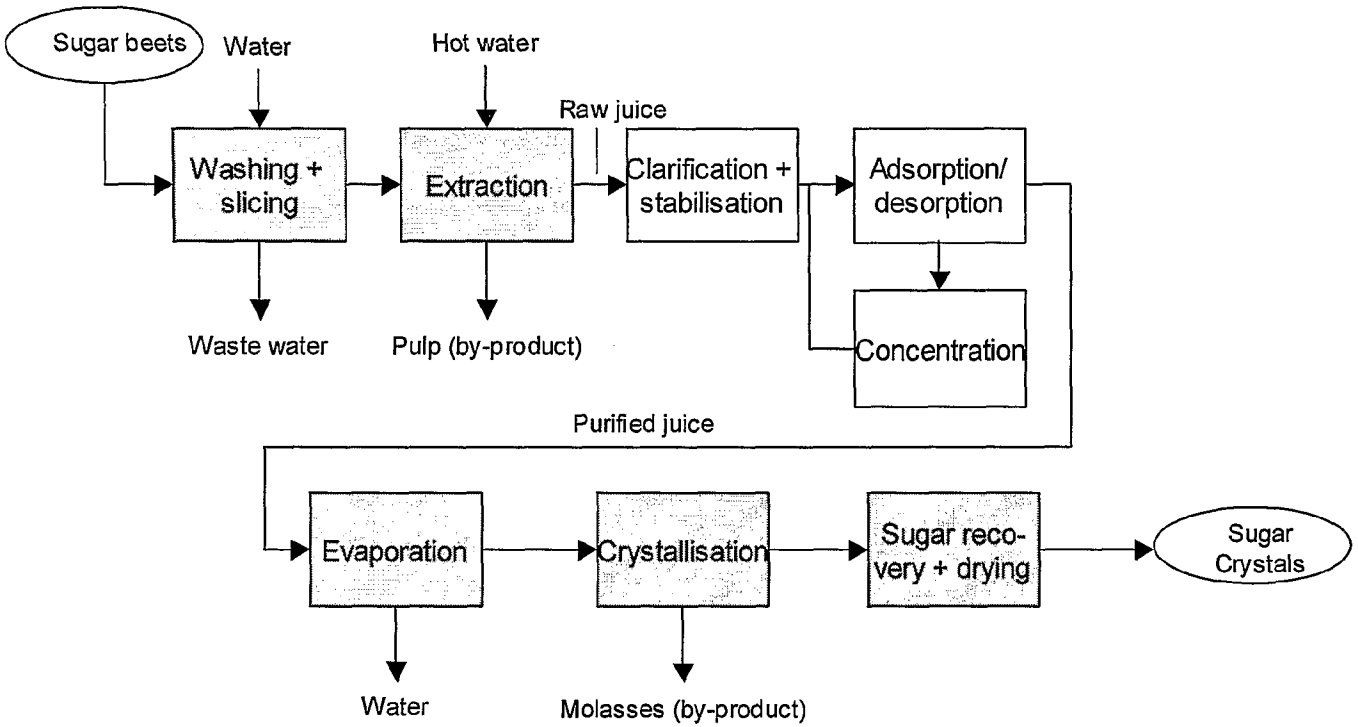
FIG. 3 shows a block diagram of a beet sugar refining process, incorporating the method of the present invention and in particular the process steps as outlined in more detail in the description and in FIG. 2.

FIG. 3 shows a block diagram of a beet sugar refining process, incorporating the method of the present invention and in particular the process steps as outlined above and in FIG. 2. A water flow comprising sugar beet cossettes or sugar cane is fed to the sugar plant. The flow comprises an aqueous sugar solution but also comprises colloidal or suspended solids, microorganisms, dissolved inorganic and organic components like ashes, amino acids, etc. Prior to the adsorptive purification of the sugar containing juice, the feed is clarified and stabilised by one or a combination of unit-operations well known to those skilled in the art, such as sieving, filtration, heating, coagulation, pasteurisation, etc. Solid particles may be removed by means of sieves. Subsequently, the stabilized and clarified raw juice is brought into contact with an adsorbent, which is fit to extract and accumulate sugar on its surface. This is preferably carried out in a SMB chromatographic unit. The feed of the SMB is at a temperature between 0° C. and 40° C. The eluent comprises water with a temperature between 40° C. and 110° C. The main part of the sucrose in the feed ends up in the extract flow. Furthermore the extract is depleted from non-sucrose and the main part of the impurities end up in the raffinate. As a result the purity of the sugar liquor increases from about 90% to more than 95% with respect to the sucrose content. The raffinate typically contains less than 10% of the sugar in the feed.

Increasing the adsorbent's surface temperature is preferably done by bringing the desorption liquid, or eluent, fed to the adsorbent, at said higher temperature. The result of raising the temperature is that the sugar, which was adsorbed by the adsorbent at low temperature, will desorb at the high temperature and will thus raise the concentration of the sugar in the liquor. After desorption, the sugar can be concentrated further and crystallized with similar techniques as the conventional process. However, due to the reduced impurities content the crystallisation is more efficient with respect to the number of crystallisation steps and the amount of molasses produced.

The present invention also provides an apparatus for extracting a carbohydrate from a raw carbohydrate juice, said apparatus comprising:

a) an adsorbent having unsaturated hydrocarbon groups exposed on its surface wherein said groups are capable of adsorbing a carbohydrate to the surface of the adsorbent by CH/π interaction;

b) means for contacting said raw carbohydrate juice with said adsorbent under conditions by which said carbohydrate is adsorbed to said adsorbent by CH/π interaction, and c) means for desorbing said carbohydrate from said adsorbent by increasing the temperature of the carbohydrate-adsorbent complex.

Essentially, the apparatus of the present invention is set up to execute the method of the invention and comprises for instance an adsorbent as specified in detail above, said adsorbent preferably being provided in the form of an adsorbent material packed into a column, suitable adsorbents are those described in more detail above; said column preferably having an input for feeding said column with the raw carbohydrate juice and desorption liquid; said column further preferably having heating means, more preferably in combination with temperature control means capable of cooling and heating and maintaining a pre-set temperature; said column further preferably comprising an output for removal of desorption liquid from the column. The input and output means are preferably provided with closing means, optionally electronically controlled. The apparatus may suitable be combined into a system for carrying out the additional steps required for sugar refining from such sources as beet and sugar cane.

The invention will now be illustrated by way of the following non-limiting examples.

EXAMPLES

Example 1

A laboratory sized adsorption/desorption column (internal diameter 2.6 cm, length 0.40 m, bed height 0.23 m) was packed with Amberchrom CG-161, a porous polystyrene adsorbent. The column was equipped with a water jacket for temperature control. The column was fed with degassed 136.1 gram per liter aqueous sucrose solution. The temperature of the feed and the column was 35° C. during the adsorption phase. The effluent of the column was collected with a fraction collector and analysed by refractometry. After feeding the column with several bed volumes sucrose solution, the flow was stopped and, to perform the desorption phase, the column was heated to 95° C. and eluted with 3 bed volumes water at 95° C. The results are summarised in Table 1.

TABLE 1

| Concentration | |
|---|---|
| Sucrose concentration feed | 136.1 g/L |
| Sucrose concentration desorption liquid | 143.6 g/L |
| Relative concentration (extract versus feed) | 105.5% |
| Mass balance | |
| Sucrose load column (g) | 15.7 |
| Desorption sucrose (g) | 15.0 |
| Sucrose recovery (extract versus feed) | 95% |

This example clearly shows that according to the invention a sucrose concentration in the extract can be obtained, which is higher than the feed concentration.

Example 2

The same adsorption/desorption column as in example 1 was fed with the permeate of microfiltrated (pore diameter 0.1 μm) raw sugar juice tapped from a beet sugar refinery. The temperature of the feed and the column was 35° C. during the adsorption phase. The effluent of the column was collected with a fraction collector and analysed by HPLC. After feeding the column with several bed volumes microfiltrated raw juice permeate, the flow was stopped and, to perform collection of the sucrose by desorption, the column was heated to 95° C. and eluted with 3 bed volumes water at 95° C. The results for sucrose are summarised in Table 2 and the breakthrough times of sugar juice components relative to the breakthrough time of sucrose in Table 3.

TABLE 2

| Concentration | |
|---|---|
| Sucrose concentration feed | 142.0 g/L |
| Sucrose concentration desorption liquid | 147.4 g/L |
| Relative concentration (extract versus feed) | 103.8% |

TABLE 2-continued

| Mass balance | |
|---|---|
| Sucrose load column (g) | 16.8 |
| Desorption sucrose (g) | 15.5 |
| Sucrose recovery (extract versus feed) | 92% |

TABLE 3

Breakthrough times of raw juice components relative to sucrose

| Component: | Relative breakthrough time: |
|---|---|
| Sucrose | 1.00 |
| Raffinose | 0.96 |
| Glucose | 0.91 |
| Fructose | 0.94 |
| Betain | 1.00 |
| Glutamine | 0.89 |
| Citric acid | 0.83 |
| Malic acid | 0.84 |
| Lactic acid | 0.89 |
| Acetic acid | 0.94 |
| PCA | 0.95 |
| Oxalic acid | 0.83 |
| Nitrate | 0.89 |
| Sulfate | 0.82 |
| Chloride | 0.87 |
| Sodium | 0.85 |
| Ammonium | 0.87 |
| Potassium | 0.85 |
| Calcium | 0.64 |
| Magnesium | 0.84 |

This example shows that according to the invention sugar from raw juice can be concentrated and that sucrose is more retained than most of the raw juice components enabling separation of sucrose from the other components.

The invention claimed is:

1. Method of extracting a carbohydrate from a carbohydrate juice, said method comprising the steps of:

a) providing an adsorbent having unsaturated hydrocarbon groups exposed on its (internal) surface wherein said groups are capable of adsorbing a carbohydrate to the surface of the adsorbent by CH/π interaction, and optionally in addition by hydrogen bonding, with the proviso that said adsorbent is not an ion exchanger;

b) contacting said carbohydrate juice with said adsorbent under conditions by which said carbohydrate is adsorbed to said adsorbent by CH/π interaction, and optionally in addition by hydrogen bonding, and c) desorbing said carbohydrate from said adsorbent by increasing the temperature of the carbohydrate-adsorbent complex.

2. Method according to claim 1, wherein said carbohydrate is selected from the group consisting of monosaccharides, disaccharides, oligosaccharides, reduced monosaccharides, reduced disaccharides, reduced oligosaccharides, and mixtures thereof.

3. Method according to claim 2, wherein:

the adsorbent is a porous material, a gel type material or a monolithic type material;

the adsorbent is a porous material;

the pores in said material have a pore size of between 8 nm and 10 μm, preferably between 8 nm and 50 nm and/or wherein said porous adsorbent material preferably has a pore volume, $V_p$, in the range of between 0.1-5 $cm^3/g$, preferably in the range of between 0.4 and 3 $cm^3/g$;

said material is provided in the form of particles, preferably said particles having a mean diameter between 50 μm and 500 μm;

said adsorbent has a surface area in a range of between 100-1500 $m^2/g$, preferably of between 500-1500 $m^2/g$.

4. Method according to claim 3, wherein:

said unsaturated hydrocarbon groups are olefins;

said olefins are unsaturated straight-chain hydrocarbon groups selected from the group consisting of vinyl, allyl, butenyl, hexenyl, pentenyl, isoprene and combinations thereof;

said straight-chain hydrocarbon groups are vinyl groups;

said unsaturated hydrocarbon groups are cycloalkene groups;

said unsaturated hydrocarbon groups comprise conjugated double bond systems;

said unsaturated hydrocarbon groups are aromatic hydrocarbon groups;

said aromatic hydrocarbon groups are styrene or phenyl groups;

said step c) comprises the use of hot water as a desorption liquid.

5. Method according to claim 3, wherein:

said unsaturated hydrocarbon groups are cycloalkene groups;

said unsaturated hydrocarbon groups comprise conjugated double bond systems;

said unsaturated hydrocarbon groups are aromatic hydrocarbon groups;

said aromatic hydrocarbon groups are styrene or phenyl groups;

said step c) comprises the use of hot water as a desorption liquid.

6. Method according to claim 1, wherein the adsorbent is a porous material, a gel type material or a monolithic type material.

7. Method according to claim 6, wherein said material is provided in the form of particles, preferably said particles having a mean diameter between 50 μm and 500 μm.

8. Method according to claim 1, wherein the adsorbent is a porous material.

9. Method according to claim 8, wherein the pores in said material have a pore size of between 8 nm and 10 μm, preferably between 8 nm and 50 nm and/or wherein said porous adsorbent material preferably has a pore volume, $V_p$, in the range of between 0.1-5 $cm^3/g$, preferably in the range of between 0.4 and 3 $cm^3/g$.

10. Method according to claim 1, wherein said adsorbent has a surface area in a range of between 100-1500 $m^2/g$, preferably of between 500-1500 $m^2/g$.

11. Method according to claim 1, wherein said unsaturated hydrocarbon groups are olefins.

12. Method according to claim 11, wherein said olefins are unsaturated straight-chain hydrocarbon groups selected from the group consisting of vinyl, allyl, butenyl, hexenyl, pentenyl, isoprene and combinations thereof.

13. Method according to claim 12, wherein said straight-chain hydrocarbon groups are vinyl groups.

14. Method according to claim 1, wherein said unsaturated hydrocarbon groups are cycloalkene groups.

15. Method according to claim 1, wherein said unsaturated hydrocarbon groups comprise conjugated double bond systems.

16. Method according to claim 15, wherein said unsaturated hydrocarbon groups are aromatic hydrocarbon groups.

17. Method according to claim 16, wherein said aromatic hydrocarbon groups are styrene or phenyl groups.

18. Method according to claim 1, wherein said step c) comprises the use of hot water as a desorption liquid.

19. Method according to claim 1, wherein the contacting step (b) is performed at a first temperature in the range of 0 to 40° C., and wherein the desorbing step c) is performed at a second temperature that is 10-100° C. higher than the first temperature.

20. Method according to claim 19, wherein the second temperature is in the range of 40 to 110° C.

21. Method according to claim 19, wherein the second temperature is 20-90° C. higher than the first temperature.

22. Method according to claim 19, wherein the second temperature is 40-80° C. higher than the first temperature.

23. Method according to claim 19, wherein the second temperature is 60-70° C. higher than the first temperature.

24. Method according to claim 1, wherein said contacting step b) is performed at 35° C.

25. Method according to claim 1, wherein said desorbing step c) is performed at 95° C.

26. Apparatus for extracting a carbohydrate from a carbohydrate juice, said apparatus comprising:

a) an adsorbent having unsaturated hydrocarbon groups exposed on its surface wherein said groups are capable of adsorbing a carbohydrate to the surface of the adsorbent by CH/π interaction, and optionally in addition by hydrogen bonding, with the proviso that said adsorbent is not an ion exchanger;

b) means for contacting said raw carbohydrate juice with said adsorbent under conditions by which said carbohydrate is adsorbed to said adsorbent by CH/π interaction, and optionally in addition by hydrogen bonding, and c) means for desorbing said carbohydrate from said adsorbent by increasing the temperature of the carbohydrate-adsorbent complex.

27. Apparatus according to claim 26, wherein the adsorbent is a porous material, a gel type material or a monolithic type material.

28. Apparatus according to claim 27, wherein the adsorbent is a porous material;

said porous adsorbent material comprises pores having a pore size of between 8 nm and 10 μm, preferably between 8 nm and 50 nm and/or wherein said porous adsorbent material preferably has a pore volume, $V_p$, in the range of between 0.1-5 $cm^3/g$, preferably in the range of between 0.4 and 3 $cm^3/g$;

said adsorbent is provided in the form of particles, preferably said particles having a mean diameter between 50 μm and 500 μm;

said adsorbent has a surface area in a range of between 100-1500 $m^2/g$, preferably of between 500-1500 $m^2/g$.

29. Apparatus according to claim 28, wherein:

said unsaturated hydrocarbon groups are olefins;

said olefins are unsaturated straight-chain hydrocarbon groups selected from the group consisting of vinyl, allyl, butenyl, hexenyl, pentenyl, isoprene and combinations thereof;

said straight-chain hydrocarbon groups are vinyl groups;

said unsaturated hydrocarbon groups are cycloalkene groups;

said unsaturated hydrocarbon groups comprise conjugated double bond systems;

said unsaturated hydrocarbon groups are aromatic hydrocarbon groups;

said aromatic hydrocarbon groups are styrene or phenyl groups;

said means for desorbing said carbohydrate from said adsorbent comprise one of heating means in the adsorbent, and/or heating means in the wall of a column comprising the adsorbent and a source of desorption liquid, wherein said source of desorption liquid has means for heating the desorption liquid and wherein said apparatus further comprises means for contacting said heated desorption liquid with said adsorbent.

30. Apparatus according to claim 28, wherein:

said unsaturated hydrocarbon groups are cycloalkene groups;

said unsaturated hydrocarbon groups comprise conjugated double bond systems;

said unsaturated hydrocarbon groups are aromatic hydrocarbon groups;

said aromatic hydrocarbon groups are styrene or phenyl groups;

said means for desorbing said carbohydrate from said adsorbent comprise one of heating means in the adsorbent, and/or heating means in the wall of a column comprising the adsorbent and a source of desorption liquid, wherein said source of desorption liquid has means for heating the desorption liquid and wherein said apparatus further comprises means for contacting said heated desorption liquid with said adsorbent.

31. Apparatus according to claim 26, wherein the adsorbent is a porous material.

32. Apparatus according to claim 31, wherein said porous adsorbent material comprises pores having a pore size of between 8 nm and 10 μm, preferably between 8 nm and 50 nm and/or wherein said porous adsorbent material preferably has a pore volume, $V_p$, in the range of between 0.1-5 $cm^3/g$, preferably in the range of between 0.4 and 3 $cm^3/g$.

33. Apparatus according to claim 26, wherein said adsorbent is provided in the form of particles, preferably said particles having a mean diameter between 50 μm and 500 μm.

34. Apparatus according to claim 26, wherein said adsorbent has a surface area in a range of between 100-1500 $m^2/g$, preferably of between 500-1500 $m^2/g$.

35. Apparatus according to claim 26, wherein said unsaturated hydrocarbon groups are olefins.

36. Apparatus according to claim 35, wherein said olefins are unsaturated straight-chain hydrocarbon groups selected from the group consisting of vinyl, allyl, butenyl, hexenyl, pentenyl, isoprene and combinations thereof.

37. Apparatus according to claim 36, wherein said straight-chain hydrocarbon groups are vinyl groups.

38. Apparatus according to claim 26, wherein said unsaturated hydrocarbon groups are cycloalkene groups.

39. Apparatus according to claim 26, wherein said unsaturated hydrocarbon groups comprise conjugated double bond systems.

40. Apparatus according to claim 39, wherein said unsaturated hydrocarbon groups are aromatic hydrocarbon groups.

41. Apparatus according to claim 40, wherein said aromatic hydrocarbon groups are styrene or phenyl groups.

42. Apparatus according to claim 39, wherein said means for desorbing said carbohydrate from said adsorbent comprise heating means in the adsorbent and/or heating means in the wall of a column comprising the adsorbent.

43. Apparatus according to claim 26, wherein said means for desorbing said carbohydrate from said adsorbent comprise a source of desorption liquid, wherein said source of desorption liquid has means for heating the desorption liquid and wherein said apparatus further comprises means for contacting said heated desorption liquid with said adsorbent.

44. A method of extracting a carbohydrate from a carbohydrate juice, comprising the steps of:

a) providing an adsorbent having unsaturated hydrocarbon groups exposed on its (internal) surface wherein said groups are capable of adsorbing a carbohydrate to the surface of the adsorbent by CH/π interaction, and optionally in addition by hydrogen bonding, with the proviso that said adsorbent is not an ion exchanger;

b) contacting said carbohydrate juice with said adsorbent under conditions by which said carbohydrate is adsorbed to said adsorbent by CH/π interaction, and optionally in addition by hydrogen bonding, wherein said contacting step is performed at 35° C. and c) desorbing said carbohydrate from said adsorbent by increasing the temperature of the carbohydrate-adsorbent complex, wherein said desorbing step is performed at 95° C.

* * * * *

UNITED STATES PATENT AND TRADEMARK OFFICE

CERTIFICATE OF CORRECTION

PATENT NO. : 8,551,250 B2
APPLICATION NO. : 11/884399
DATED : October 8, 2013
INVENTOR(S) : Vente et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1405 days.

Signed and Sealed this
Fifteenth Day of September, 2015

Michelle K. Lee

Michelle K. Lee
*Director of the United States Patent and Trademark Office*